United States Patent [19]

Jones, Jr.

[11] Patent Number: 4,898,542

[45] Date of Patent: Feb. 6, 1990

[54] ANTI-SEPARATION COAXIAL CONNECTOR TIE-STRAPS

[75] Inventor: Frank A. Jones, Jr., Temple Hills, Md.

[73] Assignee: Jerome J. Norris, Rockville, Md.

[21] Appl. No.: 116,359

[22] Filed: Nov. 4, 1987

[51] Int. Cl.[4] ..... H01R 13/639

[52] U.S. Cl. ..... 439/371; 439/369; 350/96.2

[58] Field of Search ..... 439/369, 371, 531; 24/16 PB, 16 R, 30 SP

[56] References Cited

U.S. PATENT DOCUMENTS

| | | | |
|---|---|---|---|
| 3,147,523 | 9/1964 | Logan | 24/16 PB |
| 3,739,429 | 6/1973 | Kohke | 24/16 PB |
| 4,440,465 | 4/1984 | Elliott et al. | 439/369 |
| 4,690,476 | 9/1987 | Morgenrath | 439/369 X |
| 4,752,054 | 6/1988 | Jönsson | 24/16 PB X |

*Primary Examiner*—John D. Lee
*Assistant Examiner*—John Ngo
*Attorney, Agent, or Firm*—Jerome J. Norris

[57] ABSTRACT

Tie-strap comprising dual elongated body portons with holding eyelet projections at opposite ends, and a bridging member connecting side portions of the upper areas of the strap and the eyelet projections are affixed around a cable structure joined by coaxial connectors in a manner which allows the bridging member to lie taut in parallel relationship with said cable and across said connector in order to prevent separation of said connector.

4 Claims, 2 Drawing Sheets

ANTI-SEPARATION COAXIAL CONNECTOR TIE-STRAPS

BACKGROUND OF THE INVENTION

The unintended or accidental separation of coaxial connectors, which are used in various and sundry fields in industry for transporting electrical currents, gases and liquids is a major problem which causes "downtime" that results in a multitude of problems too innumerable to catalogue exhaustively.

However, it is well known that coaxial connectors are used in abundance today in most types of electronic equipment, including computers and peripheral equipment, security and environmental control systems, office equipment systems and electronic control equipment.

In all of the fields where coaxial connectors are employed, there is a need to provide a means for ensuring against interruption of the element being transported due to unintended separation of the connectors.

Ideally speaking, the need should be met by providing an inexpensive anti-separation coaxial connector tie strap, which can be fixed in place around the connector ends with a minimum of effort, and which can be easily severed when it is intended to effect a separation for purposes such as inspection, replacements, repairs and so forth.

SUMMARY OF THE INVENTION

It is an object of the present invention to provide an inexpensive plastic anti-separation multiple tie-strapping device, which is adaptable to affixation around a cable or like transporting structure which is joined by coaxial connecting means in order to prevent unintentional separation of said connecting means.

In accordance with the present invention, there is provided a unitary or single piece flexible tie-strap comprising dual elongated body portions with semi-circular shaped holding eyelet projections at opposite ends of said elongated body portions, and a bridging member connecting side portions of the upper areas of the elongated bodies and the eyelet projections.

Straps of the elongated body portions are looped or passed around conductor portions of a cable and drawn taut through the holding eyelets to allow the bridging member to lie taut in parallel relationship to said conductor and across the coaxial connectors joining the conductor together. The drawn straps are secured against reverse movement by eyelets which hold spaced parallel traversely extending projections on flat sides of straps as gripping means for a detent in the form of a V-tooth rachet.

The dual coaxial connector tie-straps prevents any separation of the coaxial connector as long as the bridging member remains intact and unsevered.

DETAILED DESCRIPTION OF THE INVENTION

Figure 1:
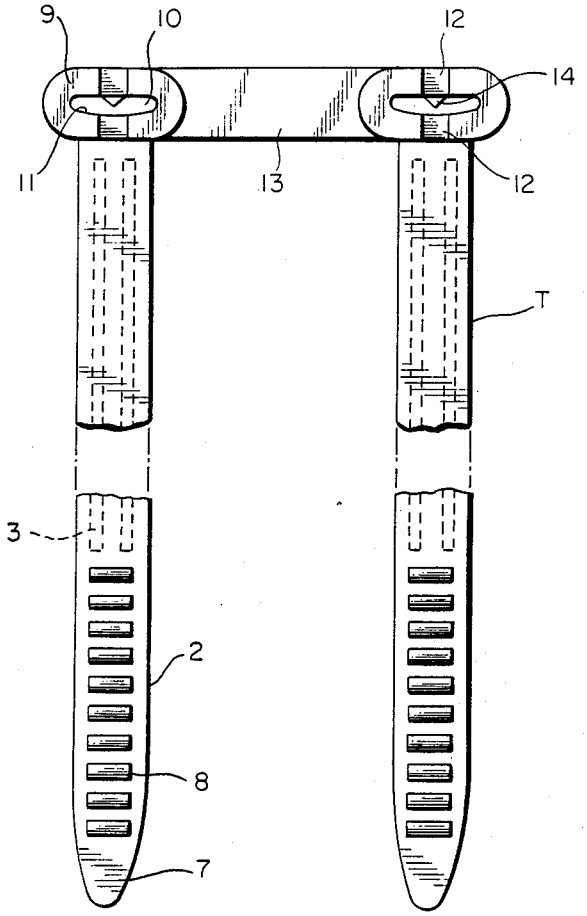
FIG. 1 is a foreshortened front elevational view showing the dual elongated tying straps.

Referring to FIG. 1, there is shown a flexible tie-strap T, molded by nylon, comprising dual elongated body portions 2 having a flat side 3, convex sides 4, and rounded, parallel marginal edges 5, and presenting semi-hemispherical configurations in cross-section.

The convex sides 4 of body portions 4 include pairs of spaced, parallel thin ribs 6, which extend along most of the length of said body portions. One end of body portion 2, comprises a tail-end portion 7, which is tapered in width and thickness and provided on its flat side 3 with spaced parallel projections 8 extending transversely to provide a gripping means.

The opposite end of the body portion 2 of the strap ends in an elongated holding eyelet 9 which projects laterally from the flat side 3 and extends at right angles to linear body portion 2; said eyelet 9 presenting a traverse aperture 10 therethrough having a convex side, a flat side and rounded ends of a size which corresponds to the cross-sectional area of the body portion 2 of the tie-strap T.

Projecting end face 11 of the holding eyelet 9 is provided with aligned rectangular slots 12 positioned centrally across the aperture 10 and extends lengthwise of the body portion 2, as shown in FIG. 1.

Figure 2:
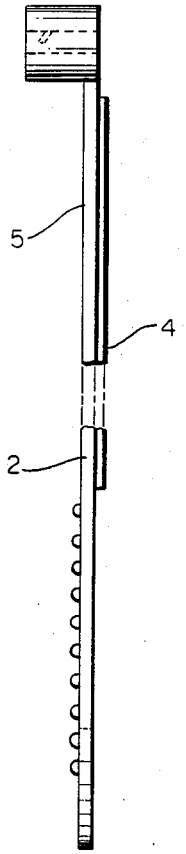
FIG. 2 is a foreshortened side view of the tying straps as seen from the right of FIG. 1.
Figure 3:
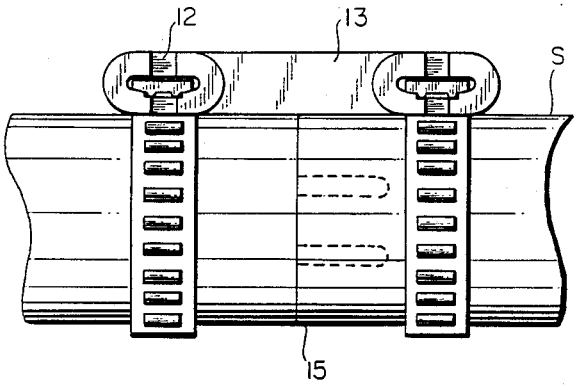
FIG. 3 is a fragmentary elevational view showing the dual elongated tying straps in a form in which it is used for securing a cable joined together by the coaxial connector.

The tie-strap of FIGS. 1 and 2 is especially adaptable for securing against unintentional separation, a cable or like transporting structure which is joined together by coaxial connecting means, as illustrated in FIG. 3.

By grasping tie-strap tail-end portions 7, and its opposite eyelet ends 9 and passing them about a transporting structure or cable so that the parallel ribbed convex sides 4 are in facing relationship with said cable, and a bridging member 13 connected the tie straps between side portions of the upper areas of the elongated bodies and their eyelet projections are made to lie taut in parallel relationship next to said cable and across the coaxial connectors joining said cable together, as shown in FIG. 3. The tail-end portions are placed through the transverse apertures until their tapered portions have been forced through.

Figure 8:
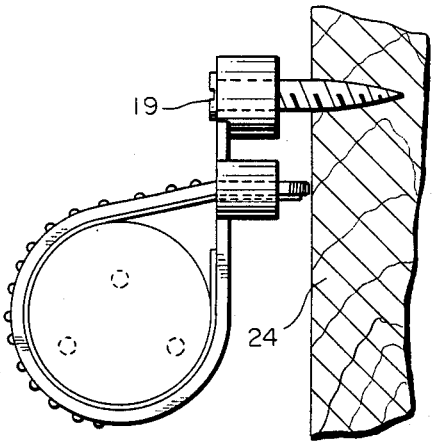
FIG. 8 is a side view in elevation of the tying straps of FIG. 7, partly in section, in a form used to secure coxial connectors, and showing an annular mounting boss anchored in a fixed support via a screw.

With the tie-straps looped around the cable structure S, any projecting tail-end portion can be drawn taut with a hand tool or pliers in order to partially cut a grip with a rectangular or V-tooth rachet 14 out of the plane of body portions 2, in a transverse direction, at a point close to the projecting end face 11 of the holding eyelet 9; to deflect the free end of the rachet tooth 14 into the lower half of the rectangular slot 12, and into abutment with the bottom thereof as shown in FIG. 3; and, in the final movement of the pliers to a closed position, to cut off the excess lengths of body portions extending through the holding eyelets therefrom at a point outwardly adjacent the projecting end faces 11 of the eyelet as shown in FIG. 8.

Further in reference to FIG. 3, it should be noted that the convex sides 4 of the body portion 2 of the tie-strap T and the convex portion of the apertures 10 in the holding eyelet are such that, when body portion 2 is looped upon itself and its tail-end portion 7 inserted into the aperture in the eyelet, the convex sides 4 of the body portions will be inverted with respect to the convex portion of the apertures 10 and produce frictional holding between the peripheral surface defining the aperture of said eyelet and the sides and marginal surfaces of the body portion of tie-strap T.

It must also be noted that when the tie-strap is secured about a cable as described, the convex sides 4 thereof, including the spaced parallel ribs 6 extending lengthwise of its convex sides 4, are disposed in firm engagement with cable structure S and therefore held against lateral shifting movement by the gripping action of the ribs, thereby maintaining bridging member 13 firm to prevent any unintentional separation of coaxial connector 15 of structure S.

Figure 4:
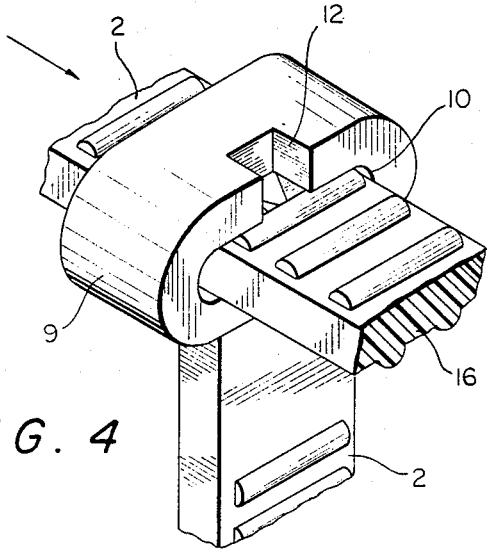
FIG. 4 is a fragmentary perspective view of the head end portion of the tying strap showing its free tail end portion looped through the aperatured boss and held against reverse movement of a V-tooth rachet emanating from a detent partially cut out of the plane of the body portion in abutting relationship with the slotted end face of the boss.

As shown in FIG. 4, the locking means for preventing reverse movement of the body portion 2 of the tie-strap relative to the holding eyelet comprises a detent in the form of a V-tooth rachet 14 which is also partially cut out of the plane of the body portion 2, lengthwise thereof with its pointed end deflected downwardly into the path of the aligned rectangular slots 12, provided in the projecting face of the holding eyelet, whereby the looped body portion 2 of the tie-strap is held in a position against reverse movement by projections.

Figure 5:
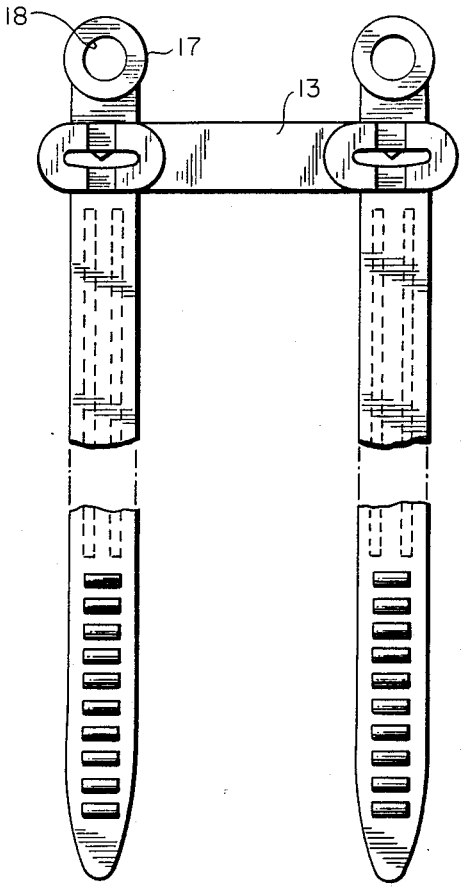
FIG. 5 is a foreshortened front elevational view showing the dual elongated tying straps with mounting bosses and apertures therethrough.
Figure 6:
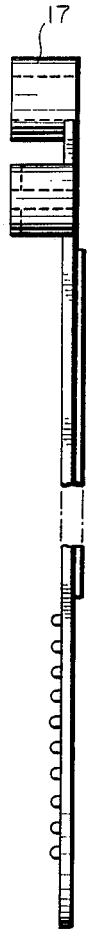
FIG. 6 is a forshortened side view of the tying straps as seen from the right side of FIG. 5.
Figure 7:
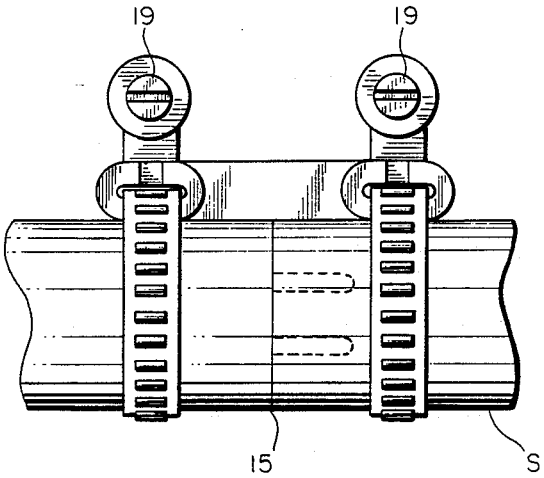
FIG. 7 is a view showing the dual elongated tying straps with mounting bosses of FIG. 5 in a form in which it is used for securing a cable joined together by coaxial connectors to a fixed support.

FIGS. 5 and 6 show modified forms of the dual elongated tie-strap with bridging connection, wherein an extension from the eyelet terminates in a mounting or circular holding boss 17 provided with a traverse aperture 18, and serves as the reception for a screw 19, as shown in FIGS. 7 and 8, for securing the tie-strap to a fixed support 24, after it is locked against reverse movement around a cable structure as described earlier.

While the invention has been described with respect to specific embodiments, it is to be understood that many changes and modifications may be made therein without departing from the same.

What is claimed is:

1. A flexible tie-strap for securing a transporting structure joined together by coaxial connectors from separating comprising: dual elongated body portions having holding eyelets with apertures extending transversely therethrough at one end and strap portions having a flat side and a convex side at opposite ends, said convex side including a pair of spaced, parallel narrow ribs along a major portion of its length and said flat side including spaced parallel projections extending transversely thereof to provide a gripping surface, wherein said apertures are provided with rectangular slots aligned in communication therewith whereby the strap portions are passed through said holding eyelets apertures, and end portions of said strap free of the aperture are in registry with said slots after locking means comprising a detent in the form of V-tooth rachets hold said straps in the holding eyelet against reverse movement; said straps having a bridging member connecting side portions of the upper areas of the elongated bodies and the eyelet projections.

2. The tie-strap of claim 1, wherein an extension from said eyelet terminates in a circular holding boss.

3. The tie-strap of claim 1, wherein the parallel projection gripping surfaces of said strap are held against reverse movement around a transporting structure joined together by coaxial connectors in a manner which allows said bridging member to be disposed tautly on parallel relationship with said structure and across said coaxial connectors to prevent separation of said connectors.

4. The tie-strap of claim 2, wherein the parallel projection gripping surfaces of said straps are held against reverse movement around a transporting structure joined together by coaxial connectors in a manner which allows said bridging member to be disposed tautly in parallel relationships with said structure and across said coaxial connectors to prevent separation of said connectors.

* * * * *